United States Patent [19]

Goldfarb

[11] 4,356,658

[45] Nov. 2, 1982

[54] MULTIPLE AND VARIED MOTION STAGE APPARATUS FOR DOLL FIGURE

[76] Inventor: Adolph E. Goldfarb, 4614 Monarca Dr., Tarzana, Calif. 91356

[21] Appl. No.: 233,551

[22] Filed: Feb. 11, 1981

[51] Int. Cl.[3] ..... A63H 33/00

[52] U.S. Cl. ..... 46/13; 46/140; 272/31 R; 40/415

[58] Field of Search ..... 46/13, 137, 138, 139, 46/140, 32, 116; 40/415; 272/31 R

[56] References Cited

U.S. PATENT DOCUMENTS

| | | | |
|---|---|---|---|
| 1,141,611 | 9/1957 | Desalme | 46/140 |
| 1,611,155 | 12/1926 | Bisaillon | 40/415 |
| 1,984,948 | 12/1934 | Sigsbee | 40/415 X |
| 2,066,239 | 12/1936 | Tahsler | 40/415 X |
| 2,622,835 | 12/1952 | Ippolito | 46/32 UX |
| 2,910,295 | 10/1959 | Dietze | 272/31 R |
| 3,498,603 | 3/1970 | Lakin | 272/31 R |
| 3,672,082 | 6/1972 | Tepper et al. | 272/31 R |

*Primary Examiner*—Mickey Yu

*Attorney, Agent, or Firm*—Romney, Golant, Martin, Disner & Ashen

[57] ABSTRACT

Stage apparatus for use with a stand-up doll figure where the doll figure not only moves across the stage area, but rotates successively in opposite directions and for different degrees of rotation to simulate life-like as distinguished from mechanical motion. The apparatus comprises a base having a stage mounted for rotation, mechanism for effecting rotation of the stage, a doll support disc mounted on the stage for rotation relative to the stage, an attaching arrangement on the support disc for releasably securing a stand-up doll figure to the disc for common rotation, and a cam arrangement between the support disc and the base which operates incident to rotation of the stage to effect rotation of the support disc and the doll figure. In one form the apparatus is arranged so that the movements of the disc and the doll figure tend to be different each time the doll figure passes across the stage area.

14 Claims, 8 Drawing Figures

10
12
16
18
20
22
24
26
28
30
32
34
38
40
44
48
50
52
56
58
60
62
64
66
74
74a
76
76a
78

MULTIPLE AND VARIED MOTION STAGE APPARATUS FOR DOLL FIGURE

FIELD OF THE INVENTION

Equipment and apparatus for use with doll figures and more particularly apparatus for supporting and effecting movement of a doll figure about a stage area.

THE PRIOR ART

There are a variety of stage devices for supporting and moving doll figures. A common type of such stage apparatus is one involving a rotatable stage where the figure is supported on the stage and simply goes around as the stage is rotated; in other words, the figure is not moved relative to the stage itself. See, for example, the U.S. Pat. No. 4,165,579, to Chase, where a doll figure is releasably secured to a support member that is disposed in a shallow receptacle on a revolving stage. There is no provision for effecting relative movement between the doll and the stage. The following additional U.S. patents show similar structures: Nelson, U.S. Pat. No. 718,721; Surman, U.S. Pat. No. 2,283,104; Handler, U.S. Pat. No. 2,846,222.

There are other devices in the prior art where motion is imparted to the figure in addition to the rotation of the stage or turntable on which the figure is supported. In this connection, U.S. Pat. No. 3,672,082 to Tepper, et al., discloses a walking mechanism for a doll. There is a rotating stage or platform having several support and walking mechanisms, each for a doll. Each mechanism includes a pair of rotatable discs which have followers received in a guide groove on the base of the device; the patent states that followers in the guide groove prevent rotation of the discs during oscillating movement of an arm mounted on the discs. The arm which is connected to the legs of the doll oscillates back and forth to move the doll legs to simulate walking motion. There are abutments on the base of the device which engage a portion of the arm to cause the arm to oscillate as the stage rotates past the abutments. It will be noted that the discs and the doll do not rotate, but rather are prevented from rotating as the stage rotates.

The U.S. Pat. No. 1,611,155, to Bisaillon, does disclose a device where figures on a stage are also themselves caused to rotate relative to the stage as the stage rotates. This relative rotation of the figures is achieved by the engagement of rollers or wheels with an arcuate track 16 that extends halfway around the periphery of the stage. It will be noted, however, that the figures rotate continuously and only in a single direction.

The U.S. Pat. No. 2,282,430, to Smith, discloses a surface that supports small figures mounted on bar magnets. Other magnets are mounted on a rotating turntable below the support surface, with the result that the small figures are caused to move in a generally circular path around the center of the turntable, and may also be caused to rotate around their own axis as they are moving around the central axis. This individual rotation of figures is always in the same direction, however.

SUMMARY OF THE DISCLOSURE

The presently preferred and illustrated embodiment of the invention contemplates not only moving a stand-up doll figure around a central axis of a rotating stage, but also contemplates life-like and varied rotation of the doll figure relative to the stage as the stage rotates. More particularly, the doll figure may be caused to rotate successively in opposite directions and for different amounts or durations of time. This provides a more life-like, as distinguished from a mechanical, motion to the doll figure. Further, in one form of the apparatus the motion may be intermittent rather than continuous, and the motions of the doll figure may be collectively different each time the doll moves across the stage area. More particularly, the doll figure may be releasably mounted on a small rotatable disc supported on the rotating stage, and fixed cam means may be provided on the base for the stage to interengage and interact with cam means on the disc, to effect the varied and intermittent rotation of the doll figure as the stage rotates and moves relative to the fixed cam means. Further, in one form of the apparatus the disc is disengaged from the cam means through at least part of the travel, so that the disc and the doll figure can assume various different positions during that disengaged time and will thus start from and be moved to different positions when reengagement is made with the fixed cam means. Particularly advantageous releasable securing means are provided on the disc for quickly and easily attaching and detaching the doll figure to and from the disc.

IN THE DRAWINGS

DETAILED DESCRIPTION OF ILLUSTRATED EMBODIMENT

Figure 1:
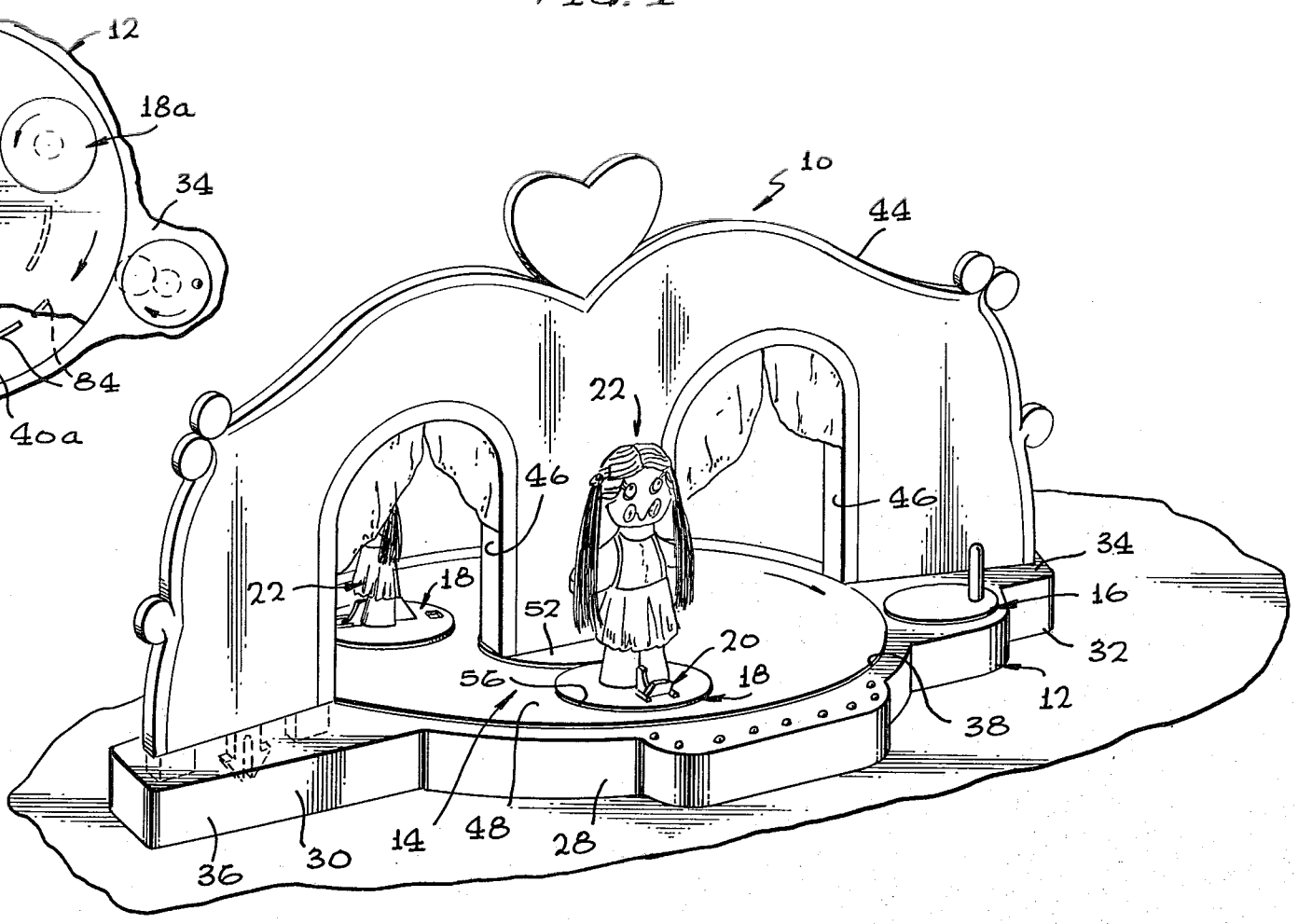
FIG. 1 is a perspective view of a doll figure stage which is a presently preferred embodiment of the invention.

Broadly, the illustrated apparatus 10 comprises a base or housing 12, a stage 14, rotatably mounted on the base, manually operable drive means 16 for effecting rotation of the stage, a plurality of stand-up doll supporting discs 18, each rotatably mounted on the stage and each including means 20 for quickly and easily releasably securing a stand-up doll figure 22 on the disc for common rotating movement. Cam means 24, 26 between the discs and the base operate to effect varied rotation of the discs relative to the stage as the stage rotates. More particularly, there are cam means 24 on the underside of the discs and fixed cam means 26 within the base for engaging the cam means 24 on the discs as the stage rotates. The child-user may thus secure the doll figure 22 in the stand-up position on a disc 18, and may manually operate the drive meas 16 to rotate the stage. During at least a portion of the stage rotation, the disc and the carried doll figure will be caused to rotate first in one direction and then in the other through different degrees of rotation. In one embodiment the motion may be intermittent, and may vary each time the doll figure crosses the stage area. In this latter respect, the rotational position of the disc and the doll may be changed when the cam means are not engaged to vary the next series of movements effected by the cam means when they reengage.

Now considering the illustrated embodiment of FIGS. 1–7 in further detail, the illustrated base 12 has a generally low flat configuration. Base 12 has a generally circular center portion 28 and a pair of outstanding wing portions 30, 32 to either side. The base includes a top wall 34 and a depending side wall 36. The top wall 34 is formed with a shallow generally cylindrical recess 38 for receiving the stage 14. The recess 38 has a bottom wall 40 and an upstanding annular side wall 42. At the center of the recess 38, there is an upstanding cylindrical center hub 42'. The base 12 supports an upstanding divider wall 44 which extends transversely and generally bisects the base, front to rear between an on-stage front area and a back or off-stage rear area. The wall 44 may be secured by any suitable means to the base 12 to maintain the wall in the upright position. The wall 44 is formed with a pair of passageways 46 each aligned at one side of the stage with the path of the doll figure supporting discs 18. The passageways 46 are generally proportioned to permit the toy figure 22 mounted on the discs to pass through as the stage rotates. The divider wall 44 may have decorative features, as desired.

The stage 14 is a generally flat cylindrically shaped part having a generally flat circular top wall 48 and a depending annular peripheral side wall 50. The stage 14 also has a slightly raised circular central portion 52 and a depending central hub 54 which is rotatably received on the center hub 42' of the base. The top wall 48 of the stage is generally flush with the top wall 34 of the base. The top wall 48 of the stage has three circumferentially generally equally spaced circular holes 56 for each receiving one of the rotatable doll figure supporting discs 18. Each hole 56 includes a depending annular flange portion. A gear 58 is formed completely around the outside of the depending peripheral wall 50 of the stage. This gear 58 is engaged by an intermediary gear 60 rotatably supported by a side extension 41 wall 40 for rotation about a vertical axis. This intermediate gear 60 is disposed on the wing 32 of the base. The gear 60 in turn meshes with another gear 62 affixed to a circular wheel 64 also mounted on the side extension wall 41 for rotation about a vertical axis. The wheel 64 has an upstanding handle 66 for rotating the wheel to thereby manually imparting rotation through the gears to the stage.

The discs 18 in any one embodiment are all alike, and therefore only one will be described in detail for each embodiment.

Figure 5:
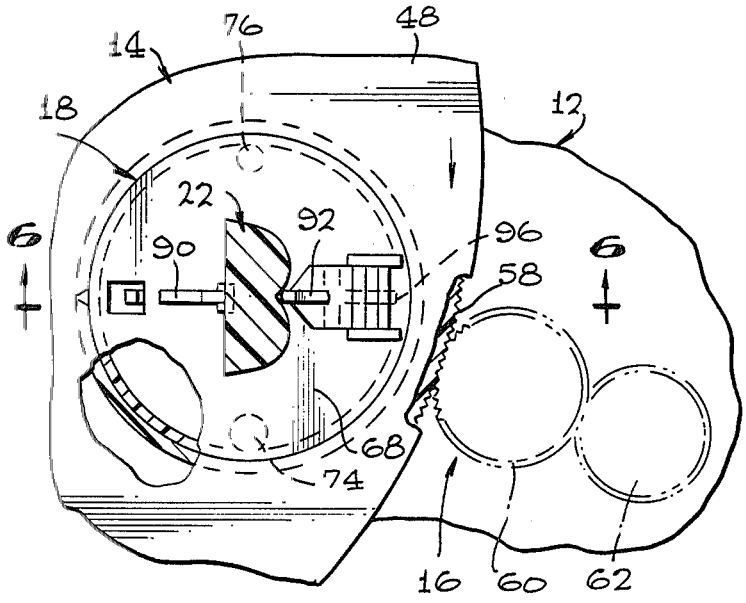
FIG. 5 is an enlarged fragmentary plan view illustrating the stage drive train and one of the rotating discs.
Figure 6:
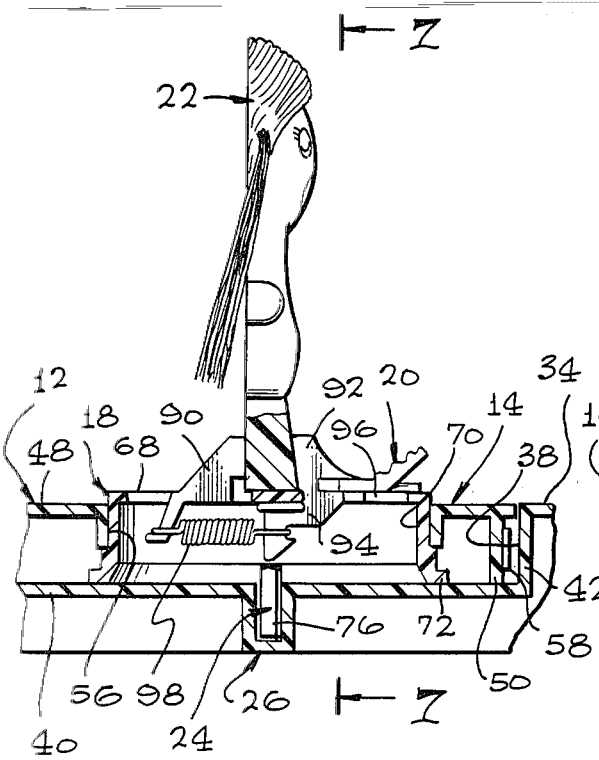
FIG. 6 is a sectional view taken generally along line 6—6 of FIG. 5.
Figure 7:
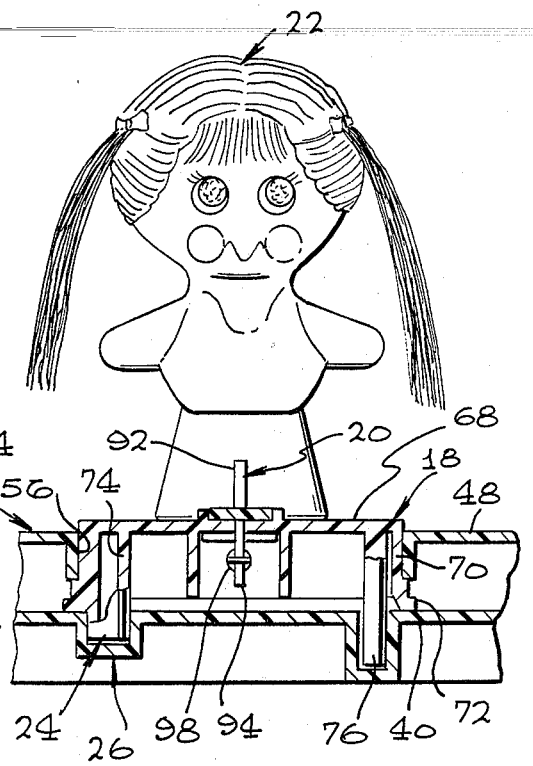
FIG. 7 is a sectional view taken generally along line 7—7 of FIG. 6.

FIGS. 5, 6 and 7 best illustrate the disc 18 for the preferred embodiment of FIGS. 1–7. The disc 18 has generally a low cylindrical configuration, with a circular top wall 68 and a depending annular side wall 70. The side wall 70 is rotatably received in one of the holes 56 of the stage and it has an enlarged lower edge 72 for restricting its upward removal from the hole. The lower edge 72 rides upon the lower wall 40 of the stage recess in the base. In general, each disc 18 is provided with cam means 24 in the form of two different off-center depending pins 74, 76 that engage cam means 26 in the form of two different upwardly open grooves *74a, 76a* on the bottom wall 40 of the base recess that respectively receive the pins 74, 76. As the stage rotates, the pins follow the grooves so as to effect the desired rotation of the disc 18 and the supported doll figure 22.

More particularly, the illustrated disc 18 has one wide short pin 74 and one narrow long pin 76. The illustrated pins 74,76 are positioned generally opposed to one another at outer ends of a diameter of the disc 18, however this exact arrangement might be altered. Each of the pins 74, 76 is generally cylindrical with a smooth, continuous outer surface. Pin 76 is longer and has a smaller diameter than pin 74. In other words, the longer pin 76 extends further downwardly from the underside of the disc. The grooves *74a, 76a* on the base are complimentary to the respective pins 74, 76. Groove *74a* is wider and shallower to accommodate the wider, shorter pin 74, while groove *76a* is narrower and deeper to accommodate the longer, thinner pin 76. This arrangement facilitates proper orientation of the disc at assembly, where is is desired to control such orientation for reasons described below. It also facilitates operation as also described below. Each of the grooves *74a, 76a* forms a continuous loop which extends generally around the center of rotation of the stage in an irregular but predetermined and fixed path. With the disc 18 in position on the stage 14, each of the pins 74, 76 extends into its respective groove *74a, 76a*. When the stage is rotated each pin moves along its groove to effect and control rotation of the disc. The configurations of the two loops are coordinated to provide the desired rotational movement for the disc and supported doll figure. More particularly, the pins 74, 76 alternate in being lead pin, and thereby effecting rotational movement of the disc in one direction, while the other pin follows. It will be noted that each groove follows a generallly smooth curve and then rather abruptly there is a definite turn or corner 78 in the groove. When the pin which is leading encounters one of the corners, a reversal occurs whereby the disc essentially rotates around that previously leading pin while the other pin moves into the leading position and the first pin then becomes the following pin. When the then leading pin encounters one of the corners the process reverses and the disc pivots about the then leading pin while the other pin takes over as leader. The disc will rotate in one direction between these corners or transition portions and will then reverse its rotation to the next corner, etc. The distances between corners determine that amount of turn in a particular direction; the illustrated apparatus is arranged to vary the amount or degree of rotation of successive turns, at least during the travel of the disc through the onstage area in front of the divider wall 44.

It will be noted that the loops intersect and cross each other at two places. The use of pins and grooves of different diameters and different lengths permits each pin to continue along the proper groove without being diverted to the other groove at such intersection. More particularly, the wide pin 74 is too wide for the narrow groove *76a*, while the long thinner pin 76 remains in and controlled by the deeper groove *76a* through the intersection.

In this embodiment it will be noted that the rotation of the disc and the doll figure is continuous in that it is always under control of the pins, and is rotating first in one direction and then the other. This controlled arrangement permits the position of the doll to be defined at all times and limied or confined to certain desired positions; for example, in the illustrated embodiment the doll may be positioned at all times facing forwardly or to the side of the stage but never rearwardly. This is particularly advantageous where the rear of the doll may be undecorated, plain or even open and therefor it is not desirable that it be viewed from the front of the stage as it moves across the stage.

Figure 8:
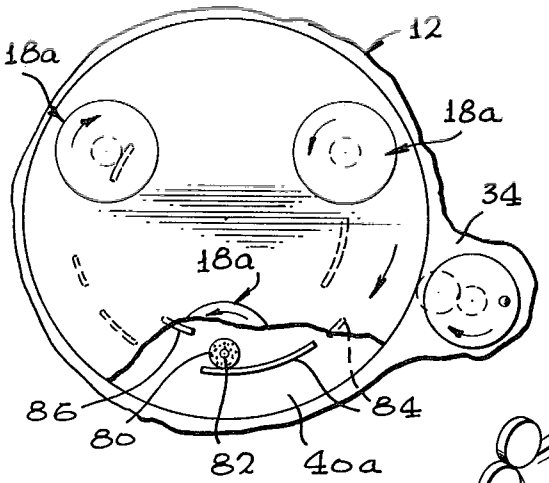
FIG. 8 illustrates an alternate embodiment of the apparatus.
Figures 2, 3:
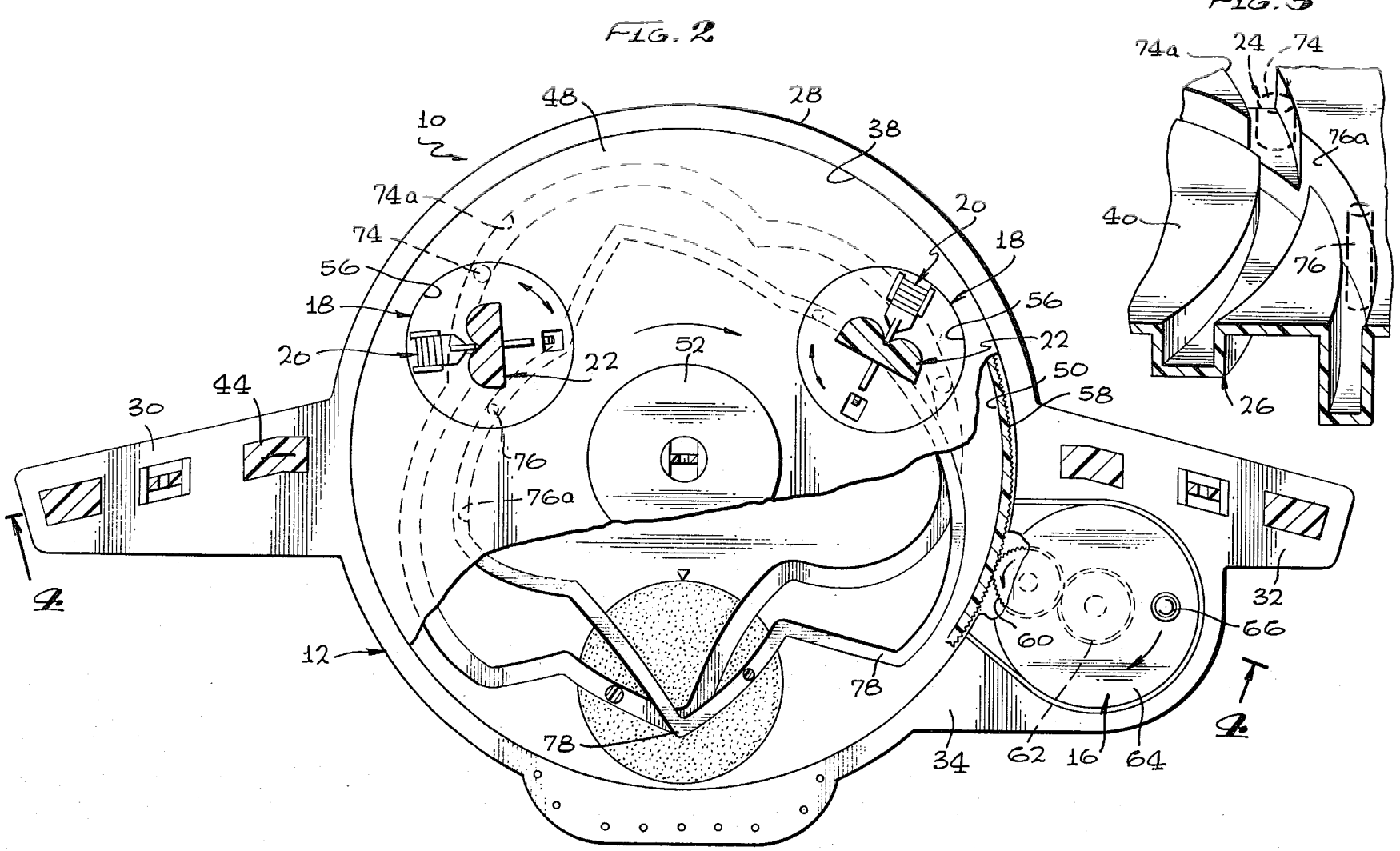
FIG. 2 is a top plan view of the stage of FIG. 1 with portions broken away and in section.
FIG. 3 is a blown-up fragmentary perspective view illustrating the cam mechanism of the stage of FIGS. 1 and 2.
Figure 4:
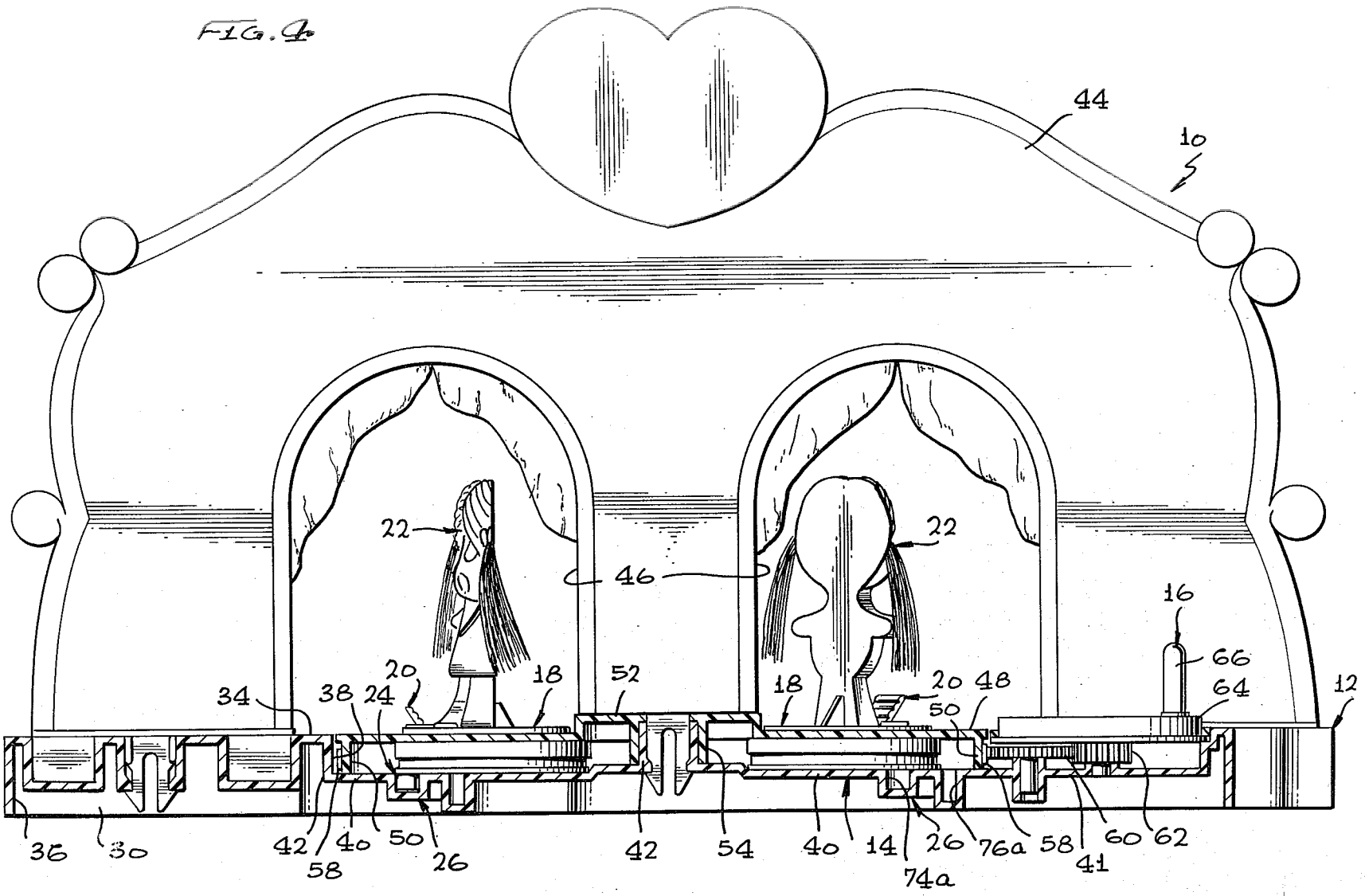
FIG. 4 is a sectional view taken generally line 4—4 of FIG. 2.

FIG. 5 shows an alternate preferred disc 18*a*. The disc 18*a* is provided with cam means 24*a* in the form of a cam wheel 80 fixed on an arm 82 depending from the underside of the disc. Complimentary cam means 26*a* are affixed to a bottom wall 40*a* of the base along the path that the disc follows as the stage rotates. More particularly the fixed cam means 26*a* on the base takes the form of two sets of depending arcuate wall sections 84, 86. One set of wall sections 86 is generally aligned in an imaginary inner circle and defines radially outwardly facing arcuate cam surfaces for engaging the radially inward portion of the cam wheel 80 and effecting rotation of the disc 18*a* in a first direction as the stage rotates. The other set of wall sections 84 is generlly aligned in an imaginary outer circle and defines radially inwardly facing arcuate cam surfaces for engaging the radially inward portion of the cam wheel 80 and effecting rotation of the disc 18*a* in a second opposite direction as the stage rotates. Each of the circles is centered at the axis of rotation of the stage. The wall sections 84, 86 may be arranged so that the cam wheel 80 goes essentially from one to the next, or they may be spaced so that the cam wheel is out of engagement with any cam surface for one or more intermediate portions of its travel. As shown in FIG. 8, the illustrated wall sections occupy generally the 180 degree on-stage portion of the stage travel in front of the divider wall but not the remaining 180 degree portion behind the divider wall. This permits the child user to orient the disc 18*a* and supported doll figure differently each time it reaches the off-stage area so that the next set of rotations will accordingly be different. The sections 84, 86 are arranged to alternatively and intermittently engage the cam wheel 80. In this connection, the doll may be rotated in one direction, then the other (with or without intermediate nonmovement) or it may rotate in one direction, stop for a duration, and then rotate again in that direction. The lengths the cam sections 84, 86 are different so that, assuming generally uniform rotation of the stage, the doll figure will undergo discrete turns for different lengths of time.

Each disc 18 carries the means 20 for releasably mounting a doll figure on the disc. Each disc has on its upper wall 68 an upstanding abutment section 90. The doll figure 22 is stood upon the disc against the abutment section 90 as illustrated in FIGS. 5 and 6.

A spring biased second retainer section 92 is movably mounted on the disc top wall 68 for movement away from and back to the holding position illustrated in FIGS. 5–7. More particularly, the retainer section 92 may include a depending leg 94 that extends through an elongated slot 96 in the top wall 18 of the disc. The retainer section 92 may be provided with suitable means to connect it to the disc for sliding movement along the disc toward and away from the other section 90. A spring 98 disposed under the disc wall 96 is secured to the leg 94 of section 92 to urge section 92 toward the other section 90. The lower end of the doll figure is thus releasably held between the two sections 90, 92. In operation, the child-user simply pushes the retainer section against the spring away from the abutment section, places the doll figure in the desired upright position on the disc, and releases the movable retainer section which is then urged by the spring against the front of the bottom end of the doll figure to urge it against the abutment section and maintain it in that fixed position on the disc for common rotation. When it is desired to remove the doll figure, the retainer section may simply be moved away or the doll figure may simply be pulled in an upwardly direction from between the sections. The illustrated doll figure has its lower end formed with a generally flat rear surface and a centrally indented forward surface which mates with the arrangement and configuration of the sections as shown best in FIG. 5.

Various modifications and changes may be made in the illustrated structure without departing from the spirit and scope of the present invention as set forth in the following claims.

What is claimed is:

1. Revolving stage apparatus for use with a doll figure, comprising:

(a) a frame;

(b) a stage mounted on the frame for rotation about a vertical axis and having an upper surface;

(c) means for effecting rotation of the stage;

(d) a doll support disc mounted on the stage for rotation relative to the stage about a vertical axis;

(e) means on said support disc releasably securing a doll figure to the disc; and (f) means between said support disc and said frame and operable incident to rotation of said stage to effect rotation of said doll support disc while said stage rotates, said rotation of the doll support disc being successively in opposite directions and through arcs of different degrees;

said disc having cam means secured thereon and said base having cam means affixed thereon below the stage and generally aligned with the path of the cam means on the disc follows as the disc rotates with the stage, to thereby effect said rotation; said disc cam means comprising off-center depending pin means and said base cam means comprising complimentary groove means for receiving and retaining said pin means and varying the radial distance of the pin means from the center of rotation of the stage incident to stage rotation; said pin means comprising a pair of depending pins of different configurations, both offset from the center of rotation of the disc, said groove means comprising a pair of grooves, each of said grooves being complimentary to one of said pins and for receiving the lower end of that pin therein.

2. The apparatus of claim 1 wherein said securing means comprises a fixed abutment on said disc and a movable spring biased element mounted on said disc for movement toward and away from said fixed abutment.

3. The apparatus of claim 2 for securing a stand-up doll figure having a configuration at its lower end comprising a flat rear wall and a front wall recessed intermediate its sides, wherein the fixed abutment has a generally flat figure-engaging surface and the movable element is generally aligned with the recess of the doll figure front wall when the doll figure is secured on the disc.

4. The apparatus of claim 1 wherein there are a plurality of said discs disposed around said stage.

5. The apparatus of claim 1 wherein said groove means follows a continuous loop disposed generally around the center of rotation of the stage.

6. The apparatus of claim 1 wherein one of said pins extends further below the surface of the disc than the other of said pins, and said grooves are accordingly of different depths to accomodate said respective pins.

7. The apparatus of claim 1 wherein one of said pins is wider than the other of said pins, and said grooves have different widths to accommodate said respective pins.

8. The apparatus of claim 1 wherein each of said grooves is a continuous loop disposed generally around the center of rotation of the stage, said grooves following non-parallel paths.

9. The apparatus of claim 8 wherein said continuous grooves intersect each other at at least two points.

10. The apparatus of claim 1 wherein said pins have a smooth configuration in transverse cross-section as do said grooves.

11. The apparatus of claim 1 wherein said grooves, said pins and said doll figure support means on the disc are arranged so that the doll figure supported on the disc never faces completely rearwardly as it moves across the stage area.

12. The apparatus of claim 1 wherein one of said pins is used to effect rotation in one direction and the other of said pins is used to effect rotation in the opposite direction.

13. The apparatus of claim 12 wherein the paths of said two grooves are coordinated to permit alternately one of the pins to be the lead pin directing rotation of the disc in a first direction while the other pin follows, and then the other of the pins to be the lead pin directing the rotation of the disc in the opposite direction while the said one pin follows.

14. The apparatus of claim 1 wherein said disc is supported solely by said pins disposed in said grooves.

* * * * *